US010626530B2

(12) United States Patent
Terai et al.

(10) Patent No.: US 10,626,530 B2
(45) Date of Patent: Apr. 21, 2020

(54) GRADING METHOD AND GRADING SYSTEM FOR KNITTED PRODUCT

(71) Applicant: SHIMA SEIKI MFG., LTD., Wakayama (JP)

(72) Inventors: Koichi Terai, Wakayama (JP); Koji Takeda, Wakayama (JP); Takenori Takatsuka, Wakayama (JP); Takahiro Aoki, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 16/095,091

(22) PCT Filed: Mar. 17, 2017

(86) PCT No.: PCT/JP2017/010858
§ 371 (c)(1),
(2) Date: Oct. 19, 2018

(87) PCT Pub. No.: WO2017/183374
PCT Pub. Date: Oct. 26, 2017

(65) Prior Publication Data

US 2019/0119837 A1 Apr. 25, 2019

(30) Foreign Application Priority Data

Apr. 22, 2016 (JP) ..... 2016-085828

(51) Int. Cl.
*D04B 35/00* (2006.01)
*D04B 37/02* (2006.01)

(52) U.S. Cl.
CPC ..... *D04B 35/00* (2013.01); *D04B 37/02* (2013.01); *D10B 2501/043* (2013.01)

(58) Field of Classification Search
CPC ..... D04B 35/00; D04B 37/02; D04B 11/26; D04B 9/42; D04B 1/22; G06F 19/00; G06F 17/50
See application file for complete search history.

(56) References Cited

U.S. PATENT DOCUMENTS 5,757,661 A * 5/1998 Surville ..... A41H 3/007 700/131
6,688,144 B2 * 2/2004 Nishikawa ..... D04B 37/02 66/232

(Continued)

FOREIGN PATENT DOCUMENTS

EP 1 329 822 A1 7/2003
EP 2 316 991 A1 5/2011

(Continued)

OTHER PUBLICATIONS

International Search Report (with translation) and Written Opinion dated Jun. 13, 2017 issued in International Application No. PCT/JP2017/010858. (7 pages).

*Primary Examiner* — Danny Worrell
(74) *Attorney, Agent, or Firm* — Rothwell, Figg, Ernst & Manbeck, P.C.

(57) ABSTRACT

Initial pattern data (50) and gauge data are stored, the pattern data is converted into knitting data based on the gauge data, and a knitted product is test-knitted. Sizes of the test-knitted product are compared with sizes indicated by the initial pattern data (50), and the pattern data or the knitting data is corrected. The correction amounts for the pattern data or for knitting data for two sizes are stored, and interpolation or extrapolation is performed based on the stored correction amounts to correct pattern data or knitting data for other sizes.

17 Claims, 13 Drawing Sheets

(56) References Cited

U.S. PATENT DOCUMENTS

| | | | | |
|---|---|---|---|---|
| 6,907,310 | B2 * | 6/2005 | Gardner | A41H 1/00 700/132 |
| 7,092,782 | B2 * | 8/2006 | Lee | G06Q 10/087 700/132 |
| 8,185,363 | B2 * | 5/2012 | Barjot | A63B 33/002 700/132 |
| 9,406,172 | B2 * | 8/2016 | Selvarajan | A41H 3/007 |
| 9,661,886 | B1 * | 5/2017 | Selvarajan | A41H 3/007 |
| 10,021,939 | B2 * | 7/2018 | Andon | D04B 37/02 |
| 2015/0366293 | A1 | 12/2015 | Clarkson | |

FOREIGN PATENT DOCUMENTS

| | | | |
|---|---|---|---|
| EP | 2 921 580 | A1 | 9/2015 |
| JP | 8-511588 | A | 12/1996 |
| JP | 3914874 | B2 | 5/2007 |
| JP | 2015-175082 | A | 10/2015 |
| WO | 2010/010775 | A1 | 1/2010 |

* cited by examiner (a)

(b)

GRADING METHOD AND GRADING SYSTEM FOR KNITTED PRODUCT

CROSS REFERENCE TO RELATED APPLICATION(S)

This application is a 35 U.S.C. § 371 National Stage of International Patent Application No. PCT/JP2017/010858, filed Mar. 17, 2017, designating the United States and claiming priority to Japanese Patent Application No. 2016-085828, filed Apr. 22, 2016. The above identified application is incorporated by reference.

TECHNICAL FIELD

The present invention relates to the grading of knitted products such as shoe uppers.

BACKGROUND ART

In knitted products such as shoe uppers, knitwears for sports or body correction, and knitted products for industrial materials, a common basic design is developed for designs of various sizes. If knitted products of different sizes are similar to each other, data of a knitted product for one size may be reduced or expanded to obtain data for other sizes. However, the knitted products of separate sizes are often not similar to each other, and thus it is necessary to repeatedly test knit knitted products for each size. For example, the group of shoe uppers have 13 sizes from 24 cm to 30 cm with an interval of 0.5 cm. It is a labor-consuming job to repeatedly test knit shoe uppers of 13 sizes in order to get the knitting data for satisfactory shoe uppers.

Patent Literature 1 (JP2015-175082A) proposes the simulation on the knitting data of sizes of knitted fabrics in order to obtain the knitted fabrics of satisfactory sizes, without performing the test knitting. Further, if the errors in the sizes of the knitted fabrics may be simulated, the pattern data representing the designs of the knitted fabrics or the like may be corrected, and the knitted fabrics of the desired sizes may be knitted. However, in particular, in the case of shoe uppers, highly accurate knitted sizes are required, and it is difficult to simulate the exact knitted sizes after knitting in consideration with the influences of physical properties of knitting yarns and the mechanisms of the knitting machine, and the like. Accordingly, it has not been practical to acquire knitting data for the desired sizes without performing the test knitting. The same applies to other knitted products which need highly accurate knitted sizes.

CITATION LIST

Patent Literature

Patent Literature 1: JP2015-175082A

SUMMARY OF THE INVENTION

Problems to be Solved by the Invention

It is an object of the present invention to reduce the number of test knitting for the grading of knitted products. In particular, it is an object of the present invention to make the test knitting of knitted product for two sizes enough for the other sizes of the knitted products so as to eliminate or reduce the test knitting for the other sizes.

Means for Solving the Problem

A grading method according to the invention for a knitted product for obtaining knitting data of the knitted product for at least three separate sizes by means of a grading system comprises:

a: a step for inputting pattern data of the knitted product as initial pattern data to the grading system;

b: a step for inputting gauge data indicating a course directional size and a wale directional size of stitches to the grading system;

c: a step for converting the initial pattern data into initial knitting data based on the gauge data by means of the grading system and for test knitting the knitted product on a knitting machine based on the initial knitting data;

d: a step for comparing a size of the test-knitted product with a size indicated by the initial pattern data manually or by means of the grading system;

e: a step for correcting the knitting data manually or by means of the grading system and for test knitting the knitted product on a knitting machine based on the corrected knitting data, when an error between the size of the test-knitted product and the size indicated by the initial pattern data exceeds a predetermined range;

and f: a step for repeating the steps d and e until the error between the size of the test-knitted product and the size indicated by the initial pattern data is within the predetermined range.

The grading method for the knitted product of the present invention is characterized in that g: the steps c to f are executed on at least two separate sizes of the knitted product, and the method further comprises:

h: a step for determining correction amounts to the initial pattern data or to the initial knitting data, in order to make the initial pattern data or the initial knitting data nearer to the knitting data or to the pattern data of the test-knitted product test-knitted in the step f, by means of the grading system, when, in the step f, the error between the size of the test-knitted product test-knitted in the step f and the size indicated by the initial pattern data is within the predetermined range; and i: a step for correcting pattern data or knitting data for sizes of un-test-knitted product through interpolation or extrapolation of the correction amounts for the at least two sizes determined in the step h, by means of the grading system.

A grading system for a knitted product according to the present invention comprises:

a memory configured to store input of initial pattern data;

a memory configured to store input values of gauge data indicating a course directional size and a wale directional size of stitches; and a data converter configured to convert pattern data into knitting data based on the gauge data, and is characterized by:

an editing means for editing the pattern data or the knitting data according to manual input or automatically so that a size of the knitted product knitted in accordance with the knitting data is made nearer to a size indicated by the initial pattern data;

and a corrector means configured to store correction amounts for the pattern data or the knitting data edited by the editing means for at least two sizes, and to correct pattern data or knitting data for other sizes through interpolation or extrapolation based on the stored correction amounts.

According to the present invention, the knitting data of knitted products are corrected through the test knitting for the at least two sizes. However, for the subsequent sizes starting from the third size, the initial pattern data or the initial knitting data are corrected by interpolating or extrapolating the correction amounts. Of course, the test knitting may be performed for three or more sizes and the resultant correction amounts may be used for the subsequent sizes through the interpolation or the extrapolation. When correction amounts for three or more sizes are present, interpolation and extrapolation by quadratic curves or the like are possible. Furthermore, the pattern data can be converted into the knitting data with the aid of the gauge data. Moreover, the association of the pattern data and the knitting data allows the conversion of the correction amounts for the knitting data into the correction amounts for the pattern data. In the present specification, the descriptions of the grading method are applicable to the grading system as they are, and conversely, the descriptions of the grading system are applicable to the grading method as they are. The course direction refers to one along which the stitches are connected to each other with a contiguous knitting yarn, and the wale direction refers to one along which the stitches are held and connected with each other; the wale direction is generally orthogonal to the course direction.

To associate the pattern data with the knitting data, the outlines of these data are associated with each other. Further, the outlines are associated with outlines for other sizes. To associate the outlines with each other, the correction amounts at predetermined positions along the outlines are stored and the positions along the outlines are made comparable between the separate sizes. Here, some functions or the like may be used, if they have a variable expressing the positions along the outlines and determines the correction amounts according to the positions along the outlines. In this case, the characteristic points to be described later are not explicitly used. However, such abstract procedures are difficult to carry out.

Therefore preferably, the grading method for a knitted product further comprises:

j: a step for specifying a plurality of characteristic points along an outline on the pattern data and along an outline of a knitted fabric in the knitting data by means of the grading system, wherein the plurality of characteristic points are associated with each other between the pattern data and the knitting data and are further associated with each other between pattern data for separate sizes and k: wherein, in the step h, the grading system determines correction amounts for respective characteristic points based on shift amounts of the characteristic points between the knitting data or the pattern data of the knitted product test-knitted in the step f and the initial pattern data or the initial knitting data.

With this configuration, the pattern data and the knitting data are associated with each other by means of the characteristic points, and the characteristic points are associated with each other between the sizes. Accordingly, for example, the characteristic points with respect to knitting data for one size may be associated with the characteristic points with respect to pattern data for other sizes. Both the pattern data and the knitting data may be corrected by means of the correction amounts for the characteristic points with respect to one size, and other pattern data or knitting data for different sizes may similarly be corrected.

Preferably, the knitted product comprises a plurality of areas having different characteristics and in the step j the grading system specifies characteristic points at a border between the areas.

Not only the outlines of knitted products but also sizes of areas in the knitted products may be made nearer to the pattern data. For example, if knitted products have a design such as changes in knitting yarns, changes in the knitting structure, or the like, these designs may be made faithful to the pattern data.

Preferably, the correction amounts comprise a correction component along the course direction and a correction component along the wale direction, the correction component along the course direction is a ratio of shift amounts of the characteristic points along the course direction and a knitting width along the course direction of the knitted product, and in the step i, the pattern data or the knitting data is corrected by multiplying the correction component along the course direction determined through the interpolation or extrapolation and the knitting width along the course direction of the knitted product for each size.

We have found empirically that, along the course direction, the accuracy in size of a knitted product is improved by means of the correction amounts comprising the ratio of the shift amounts and the knitting width along the course direction than the correction amounts comprising the shift amounts itself determined through the interpolation or the extrapolation. In contrast, we have found empirically that, along the wale direction, the correction amounts comprising the shift amount itself and the correction amounts comprising the ratio of the shift amounts and the knitting length along the wale direction do not yield substantial difference in the results.

Preferably, the knitted product is a footwear. In general, footwears have many sizes, and in particular, pattern data for shoe uppers are not similar to each other between the sizes, and therefore test knitting in grading is particularly troublesome. Accordingly, it is particularly important to reduce the number of test knittings. Besides footwears, knitwears for body correction or for sports are appropriate for the present invention, since they need accurate sizes as defined in the pattern data and therefore need repeated test knitting. The same applies to industrial materials.

Preferably, the knitting data of the knitted product for each size is provided with a main body and a separable portion, and the step h further comprises:

h-1: a step for generating two data of integrated data where the separable portion is slid and merged with the main body and main body data where the separable portion is separated and the main body remains, based on the knitting data of the test-knitted product for the at least two sizes; and h-2: a step for generating, for each size of the test-knitted product, two correction amounts of correction amounts for converting the initial pattern data to the integrated data and correction amounts for converting the initial pattern data to the main body data, and the step i further comprises:

i-1: a step for generating, for each size of un-test-knitted product, two corrected pattern data with correcting the initial pattern data through interpolation or extrapolation of the two correction amounts for the sizes test knitted and for generating two knitting data of corrected integrated data and corrected main body data based on the two corrected pattern data;

i-2: a step for determining an area included in the corrected integrated data and not included in the corrected main body data through differentiation for each size of un-test knitted product, for sliding the determined area in a reverse direction to a direction in the integration, and for generating an area representing the separable portion; and i-3: a step for adding the area representing the separable portion to the corrected main body data and for generating the corrected knitting data for each size of un-test-knitted product.

Further preferably, in order to process a knitted product whose knitting data contains a main body and a separable portion, the grading system for a knitted product further comprises:

a sliding means for sliding the separable portion to the main body with respect to the knitting data edited by the editing means in order to obtain integrated data;

a separation means for separating the separable portion from the main body and for obtaining main body data with respect to the knitting data edited by the editing means, wherein the corrector means generates two correction amounts of one from the initial pattern data to the integrated data and the other from the initial pattern data to the main body data, corrects for other sizes the initial pattern data through interpolation or extrapolation of the two correction amounts, generates two corrected pattern data, and generate two knitting data of corrected integrated data and corrected main body data based on each of the corrected pattern data, a differential means for determining an area included in the corrected integrated data and not included in the corrected main body data through differentiation;

an un-sliding means for sliding, in a reverse direction to a direction in the integration, the area determined by the differential means and for generating an area representing the separable portion; and an addition means for adding the area representing the separable portion to the corrected main body data and for generating corrected knitting data.

The separable portion may be, for example, a flechaged portion knitted through flechage, but is not limited to this. While the optimal knitting data or the optimal pattern data of the knitted product with the separable portion may be obtained through test knitting, it is difficult to recognize how to locate the boundary between the separable portion and the main body from the initial pattern data.

Accordingly, the initial pattern data is associated with the integrated data and the main body data to determine correction amounts. When the correction amounts determined for the at least two sizes are interpolated or extrapolated, the correction amounts for other sizes are determined, and the corrected integrated data and the corrected main body data are also determined. The area comprising the difference between them indicates the separable portion that has been slid toward the main body. Accordingly, when this area is slid in a reverse direction to the direction in the integration, the shape of the separable portion for each size is determined, and the addition of the separable portion to the corrected main body data yields the corrected pattern data for each size. Accordingly, the separable portion does not hinder the grading. Of course, the addition of the separable portion to the corrected main body data may be the addition of the separable portion to the data obtained by subtracting the area corresponding to the separable portion from the corrected integrated data.

Preferably, in the step i-2, the determined area is approximated as a polygon having an upper side and a lower side and the determined area is slid in such a way that the longer one of the upper side and the lower side is made flat. In the present specification, the knitted products are assumed to be knitted from the bottom to the top, and the upper and the lower sides of the relevant data are represented accordingly. And the horizontal direction in the knitting data represents the course direction in knitting.

Preferably, in the step h-1, characteristics in the shape of the separable portion prior to the integration are stored and in the step i-2, the determined area is slid so as to approximate the shape of the separable portion prior to the integration. With this configuration, the un-sliding may be performed when the separable portion has a complicated shape and both the upper and lower sides are not flat prior to the sliding.

BRIEF DESCRIPTION OF DRAWINGS

FIG. 11(*a*) illustrates the initial pattern data of the smallest size sample; FIG. 11(*b*) illustrates the initial pattern data of the largest size sample; FIG. 11(*c*) illustrates the knitting data of the smallest size sample after test knitting; and FIG. 11(*d*) illustrates the knitting data of the largest size sample after test knitting.

FIG. 14(*a*) illustrates knitting data of the smallest size sample; and FIG. 14(*b*) illustrates knitting data of the largest size sample.

FIG. 15(*a*1) illustrates data without the flechaged portions; and FIG. 15(*a*2) illustrates data with the flechaged portions.

FIG. 16(*a*) illustrates the difference between the data on the right side in FIG. 15 and the data on the left side thereof; and FIG. 16(*b*) illustrates data where the sliding is canceled so that the upper side of the data in FIG. 16(*a*) becomes flat.

DESCRIPTION OF EMBODIMENT

Hereinafter, the best embodiments for carrying out the present invention will be described.

EMBODIMENT

Figure 1:
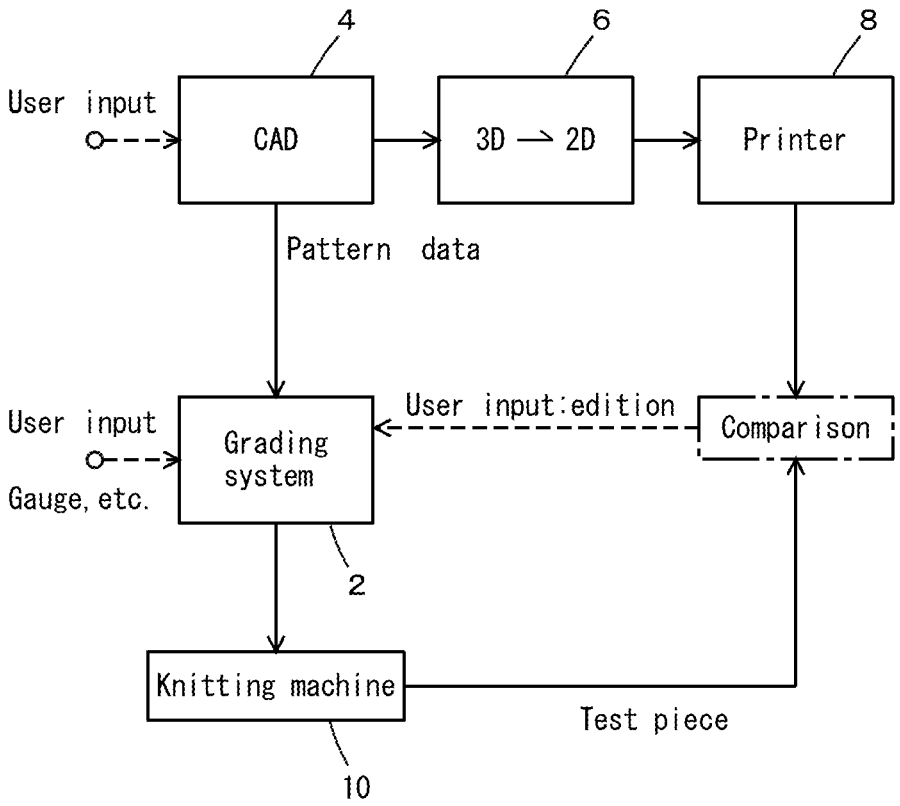
FIG. 1 is a diagram illustrating a grading system according to an embodiment and its periphery.

FIGS. 1 to 10 show a grading system 2 according to an embodiment and its modification with reference to a shoe upper design as an example. In FIG. 1, the reference numeral 4 denotes a CAD device and it is configured to design shoe uppers made of a knitted product in a plurality of sizes. The design data is three-dimensional, and the three-dimensional design data is converted into two-dimensional pattern data by a 2D converter 6. In the design data, the three-dimensional shape of the shoe upper is specified together with sizes of portions thereof, and also in the pattern data, the sizes of the portions of the shoe upper are specified. In FIG. 1, the block indicated by a dashed line denotes a manual process for example, and inputs denoted by a dashed line refer to manual input.

The pattern data is for example vector data and contains data of the outline of the shoe upper, data of areas in the shoe upper, and data of boundaries between the areas. Here, an area refers to a region in the knitted fabric, having the same characteristics, knitted with the same knitting yarn and in the same knitted structure, for example, and sizes of the areas are also specified in the pattern data.

From the vector data, the bent points in the outline and the areas, the start and end points of the outline and the areas, the intersections between the outline and the areas, and so on are extracted and specified as the characteristic points by the 2D converter 6 or by the CAD device 4. The positions of characteristic points change depending on the sizes of the shoe uppers, but the number and the relative positions of the characteristic points are in common among the pattern data for various sizes. If the number or the relative positions of characteristic points are dependent on the sizes of shoe uppers in the CAD program of the CAD device 4, they are pretreated to be independent of the sizes.

A printer 8 prints out the pattern data onto a paper or the like with the size specified by the pattern data. The CAD device 4 through to the printer 8 constitute the background of the present invention.

The grading system 2 accepts and stores inputs of gauge data of a knitted fabric and also of pattern data for various sizes and converts the pattern data into the knitting data. And then, shoe uppers are test-knitted based on the knitting data on a knitting machine 10 such as a flat knitting machine and are brought into the state of a product by such processes as setting and thermal treatment. Thereafter, the sizes of the shoe uppers are manually compared with the pattern data printed on the paper in order to determine the error in size. The knitting data or the pattern data is corrected so as to eliminate the error. When shoe uppers of satisfactory sizes are obtained, a correction vector for each characteristic point is determined; in the embodiment, the correction vector comprises two components, one along the course direction (x-direction) and one along the wale direction (y-direction). The correction vectors for the individual characteristic points are determined for shoe uppers of at least two sizes. The correction vectors for the individual characteristic points in the at least two sizes are interpolated or extrapolated and the pattern data or the knitting data of other sizes are corrected.

Figure 2:
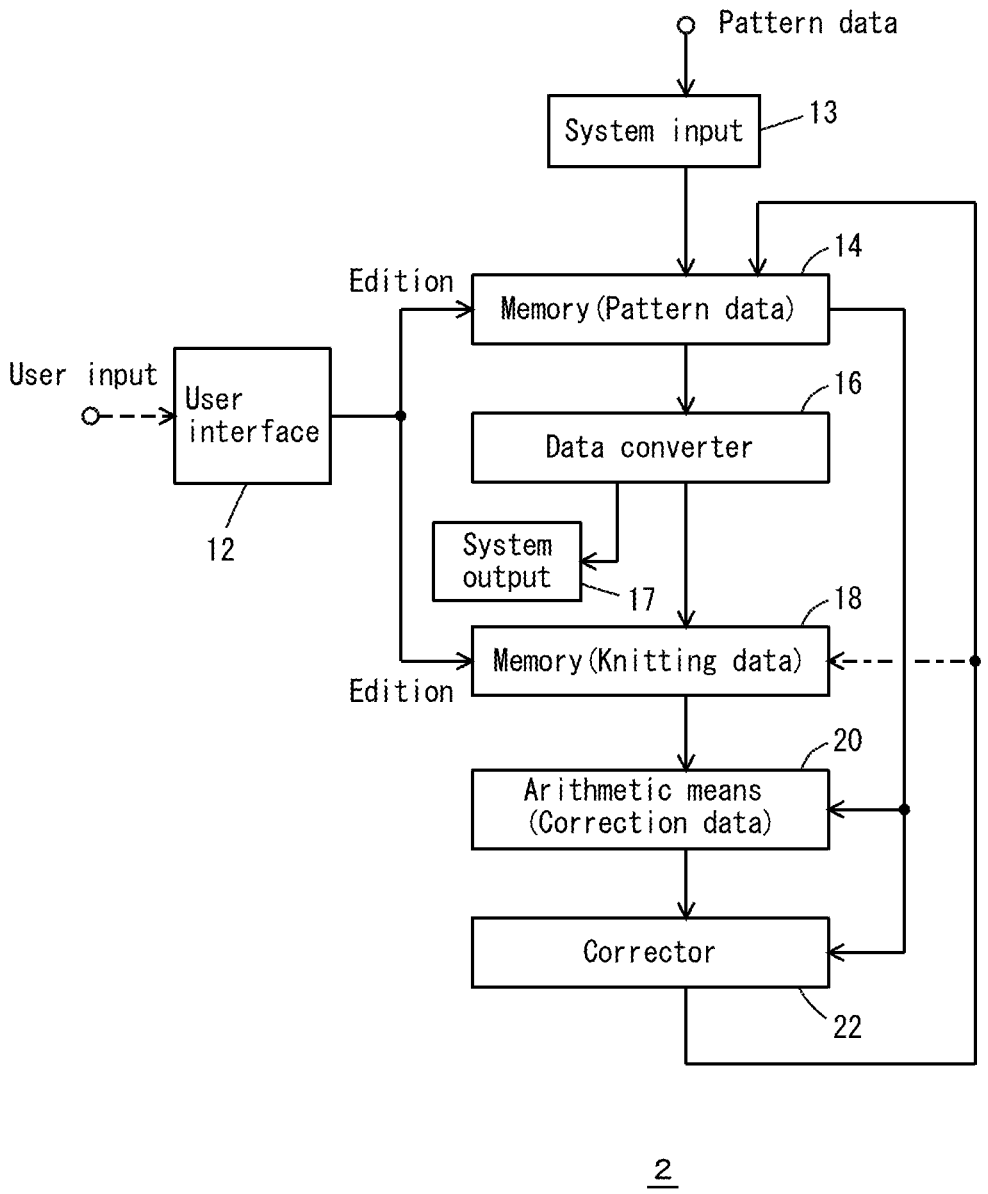
FIG. 2 is a block diagram of the grading system of the embodiment.

FIG. 2 shows the architecture of the grading system 2 and it may be constituted by a single device or plural devices. A user interface 12 accepts and stores an input of gauge data from a user, the user interface 12 also functions as an editing means and accepts the edition of the knitting data or the pattern data by the user. By this way, the knitting data or the pattern data is edited so that the sizes of the knitted shoe upper are made nearer to the sizes specified by initial pattern data. Here, the gauge data is a gauge data, for example, for the largest area in the shoe upper and indicates the sizes of stitches along the course direction and along the wale direction. A system input 13 accepts inputs of pattern data or the like for various sizes, and the input data are stored in a memory 14. The memory 14 stores the initial pattern data and stores further the latest pattern data, for example.

A data converter 16 converts the pattern data into the knitting data (data for driving the knitting machine 10) based on the gauge data. If a shoe upper has a plurality of areas, then, for example, the largest area is used as a representative area, and the gauge data in this area is used. Note that the sizes are specified in the pattern data, and vertical and longitudinal sizes of the stitches are specified by the gauge data. The knitting data is outputted from a system output 17, and the shoe upper is test-knitted on the knitting machine.

Because the data converter 16 can recognize which stitches in the knitting data are associated with which positions on the pattern data, the data converter 16 can associate the characteristic points with positions in the knitting data, for example, stitch positions in the knitting data. As a result, characteristic points are associated with each other between pattern data for various sizes and the characteristic points are also associated with the pattern data and the knitting data. Accordingly, for example, the characteristic points in knitting data for one size can be associated with the characteristic points in pattern data for other sizes or the characteristic points in knitting data for other sizes. Similarly, the characteristic points in pattern data for one size can be associated with the characteristic points in pattern data for other sizes or the characteristic points in knitting data for other sizes.

A memory 18 stores the initial value and the latest value of the knitting data for example. The minimal data to be stored in the memories 14 and 18 is the initial pattern data and the latest knitting data. When shoe uppers of satisfactory sizes have been test-knitted, shift amounts indicating the degree of shift amounts of the characteristic points from the initial pattern data or from the initial knitting data are determined by an arithmetic means 20, and the correction vectors for the respective characteristic points with respect to the shoe uppers in the two sizes are stored. Here, it is preferable to make the course directional component of the correction vectors Vx/x where the shift amounts Vx along the course direction of a characteristic point is divided by a knitting width x along the course direction. The wale directional component of the correction vector may be a ratio Vy/y with respect to the knitting width or maybe shift amounts amount Vy itself.

A corrector means 22 corrects the pattern data of shoe uppers of the sizes without the test knitting by interpolating or extrapolating the correction vectors of the characteristic points for the two sizes test-knitted. Based thereon, the final knitting data are obtained by the data converter 16. Alternatively, knitting data for other sizes may be directly corrected by interpolating or extrapolating the correction vectors of the characteristic points for the two sizes test-knitted. When interpolating by for example a straight line between the characteristic points as the correction of the characteristic points, the knitting data or the pattern data may be corrected.

By means of the grading system 2, for shoe uppers for example in thirteen sizes, test knitting for the two sizes are necessary, and thus test knitting of shoe uppers for the other eleven sizes are omitted. If it is clear that a further slight correction of the test-knitted shoe upper in the next test knitting results in a shoe upper of the exact size, the knitting data may be corrected without the next test knitting and may be used as the knitting data for the exact size. Furthermore, when the sizes of the test-knitted shoe upper are compared with the sizes in pattern data, the knitting data is corrected according to the embodiment, but the pattern data may be corrected.

Figure 3:
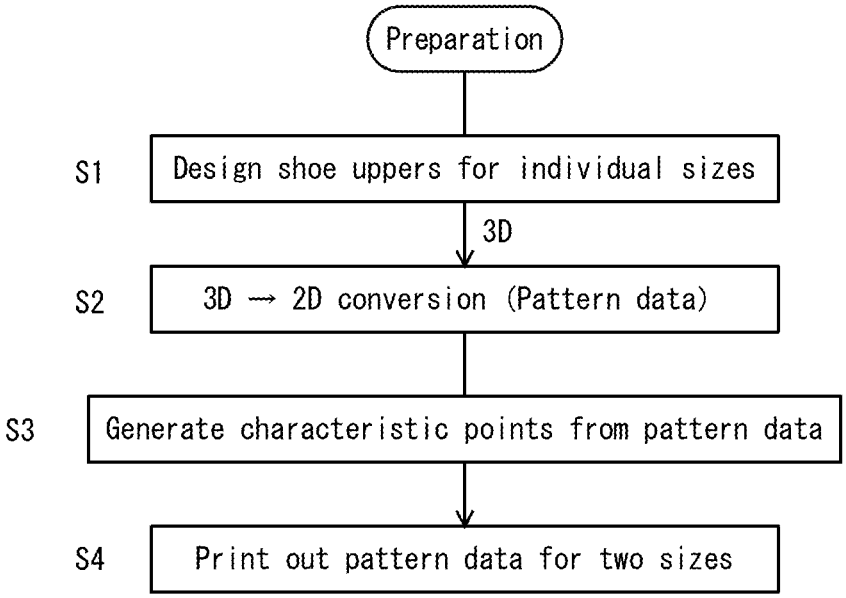
FIG. 3 is a flowchart of the preparation for the grading.

FIG. 3 shows the preparation process for grading; for example in step S1, shoe uppers for individual sizes are designed, while they may be designed in separate stages. In step S2, the design data is converted from three-dimensional data into two-dimensional data, and the pattern data specifying the sizes of respective portions is resultant. In step S3, the characteristic points are generated from the pattern data. The pattern data is vector data for example, and the extraction of endpoints of vectors or the like may generate the characteristic points. Then, in step S4, pattern data for two sizes are printed out. By the way, one size of shoe upper may be designed and may be converted into two-dimensional pattern data, and then the grading from the pattern data may be performed.

Figure 4:
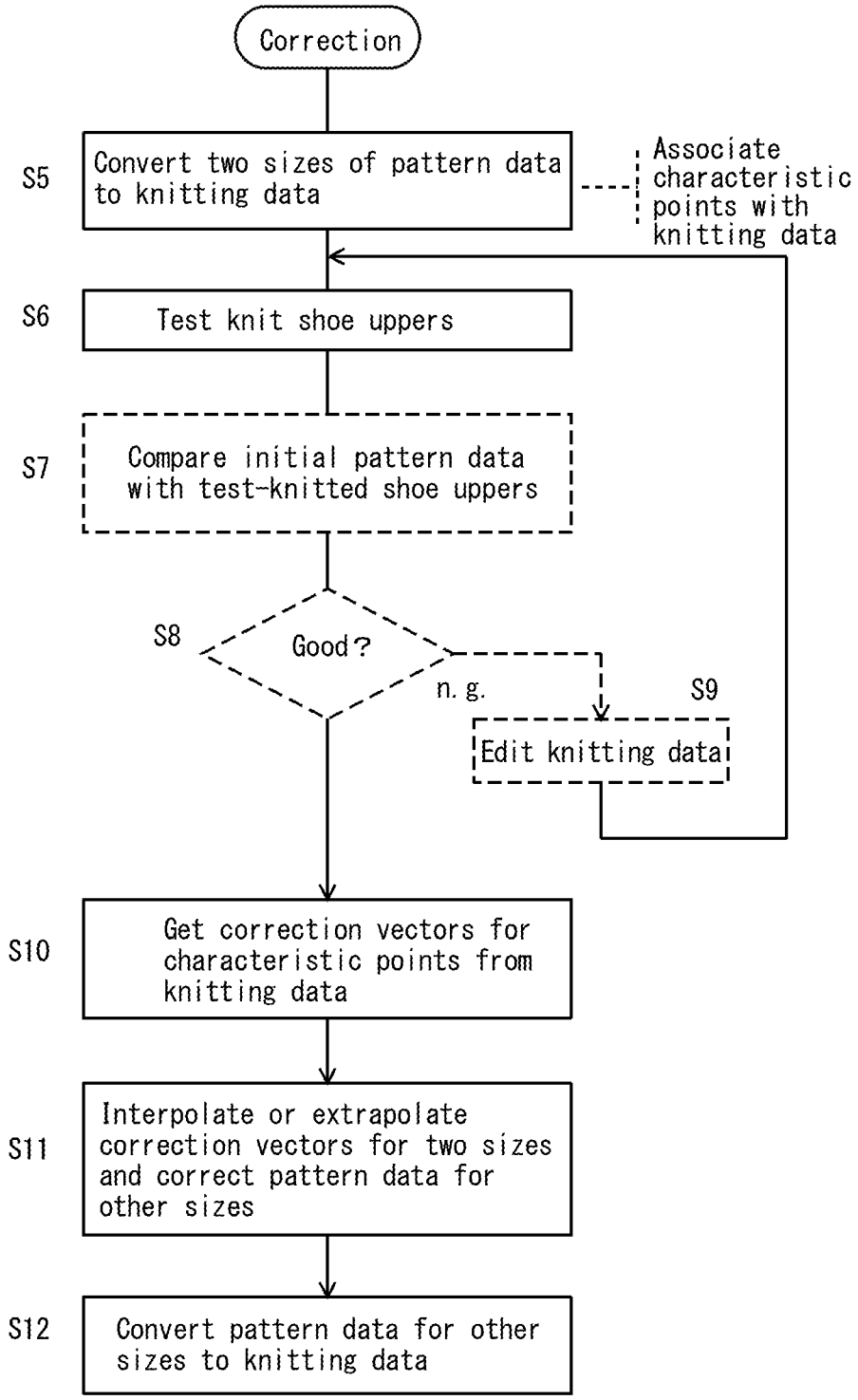
FIG. 4 is a flowchart of a grading method according to the embodiment.

FIG. 4 shows a process according to the embodiment; blocks indicated by dashed lines denote for example manual processes. In step S5, two sizes of initial pattern data are converted into initial knitting data. They may be converted into the knitting data in separate stages. Then, the characteristic points are also associated with the knitting data.

In step S6, shoe uppers are test-knitted. In step S7, the sizes of the initial pattern data and the sizes of the test-knitted shoe uppers are compared manually or by the editing means 30 in FIG. 10, and in step S8, the error in size is evaluated manually or automatically. If the error is within an acceptable range, step S10 is performed. Otherwise, step S9 is performed so that the knitting data is edited manually or automatically, and then the process returns to step S6.

In step S10, shift amounts of the characteristic points between the initial knitting data and the latest knitting data are determined and are used as the correction vectors; they are composed of two components along the course direction and the wale direction. The course directional component of the correction vector is preferably a ratio Vx/x; Vx is shift amounts of characteristic points and x is the knitting width along the course direction.

In step S11, the correction vectors for the two sizes are interpolated or extrapolated to determine correction vectors of characteristic points for other sizes without test knitting, and thus their pattern data or knitting data is corrected. When the ratios Vx/x at two points are interpolated or extrapolated, the resultant Vx/x is multiplied by the knitting width x along the course direction and the product is made the correction amounts of the course directional component. When the pattern data is corrected in the step S11, the corrected pattern data is converted into knitting data in step S12.

Figure 5:
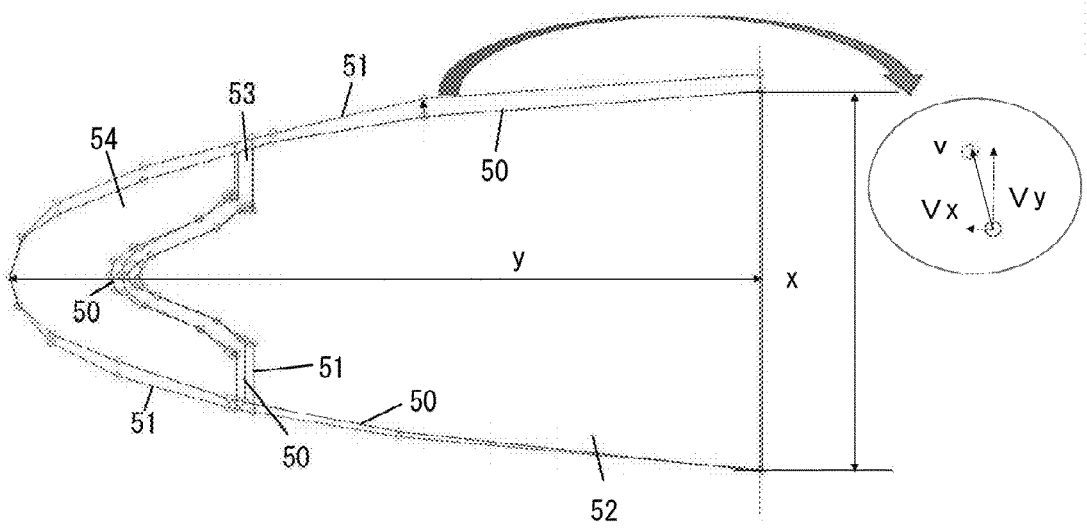
FIG. 5 is a diagram schematically illustrating pattern data and characteristic points according to the embodiment.

In FIG. 5, the pattern data is indicated by solid lines, the characteristic points by circles, and one of the correction vectors is enlarged and depicted at the upper right portion. The reference numeral 50 denotes the initial pattern data and the reference numeral 51 denotes the corrected pattern data. There are three areas 52 to 54 along the y-direction (wale direction), and correction vectors V are composed of two components of Vx and Vy.

Figure 6:
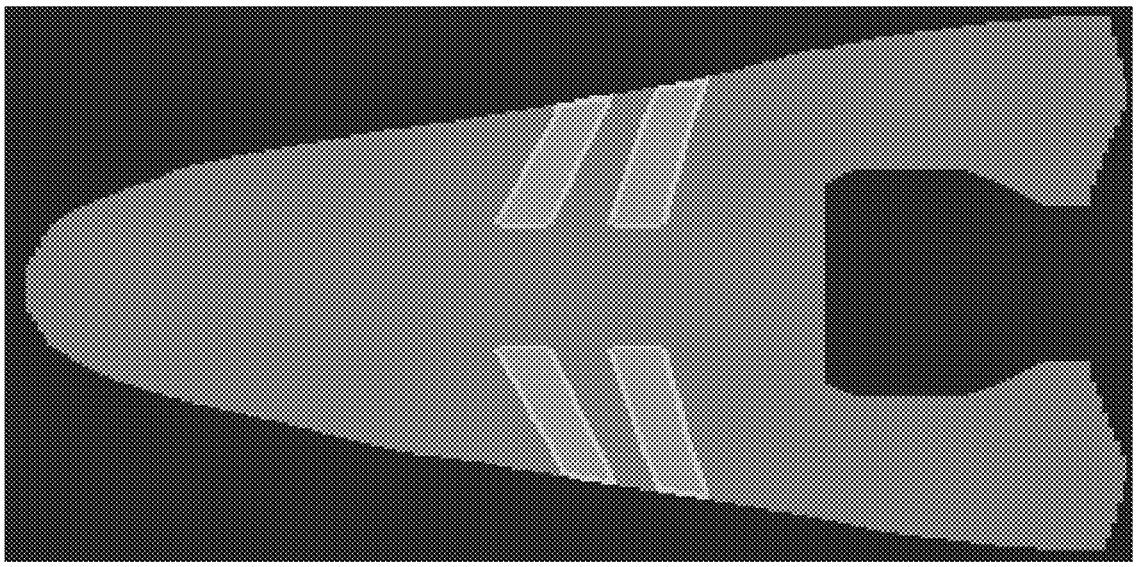
FIG. 6 is a diagram illustrating an example of knitting data.
Figure 7:
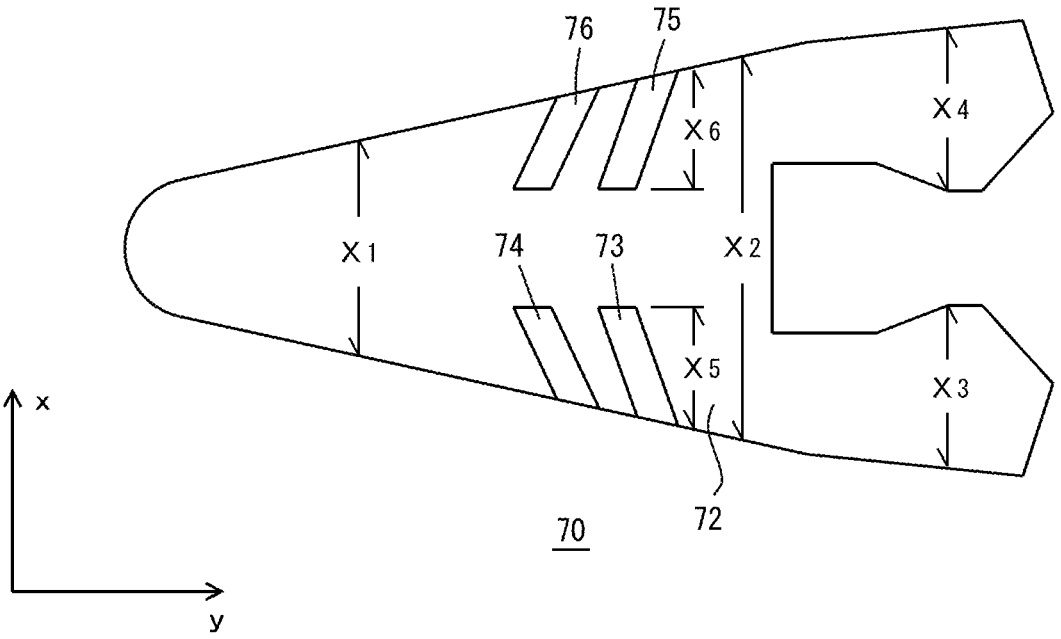
FIG. 7 is a diagram schematically illustrating sizes along the course direction.

FIG. 6 shows an example of knitting data and FIG. 7 schematically shows pattern data 70 corresponding to the knitting data. The reference numerals 72 to 76 denote areas, and knitting widths X1 to X6 along the course direction and the like are determined for each area. The areas 73 and 74 and the areas 75 and 76 will serve as two parallel bars on the knitted shoe upper but they are not parallel to each other in FIG. 7. They will become parallel through knitting and so on.

Figure 8:
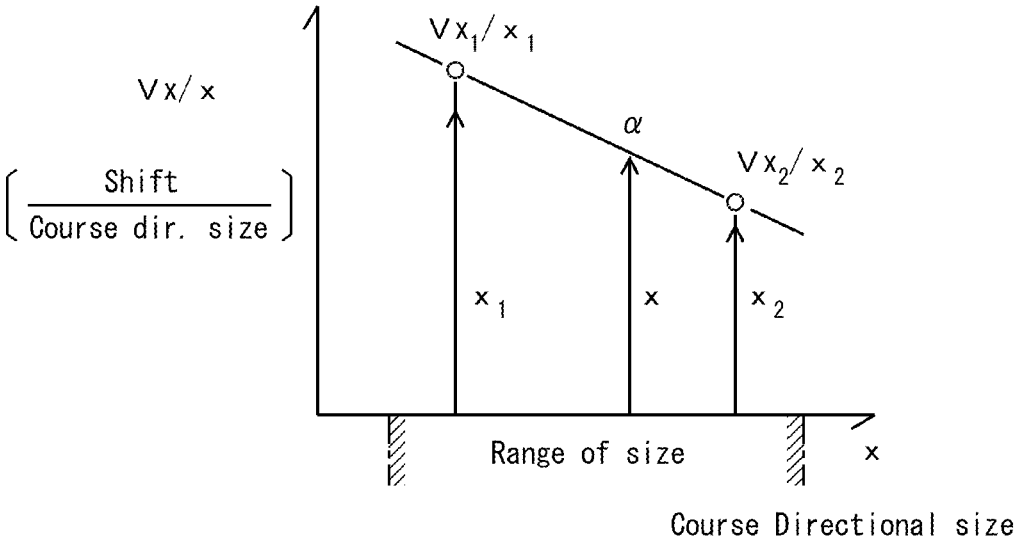
FIG. 8 is a diagram schematically illustrating corrections along the course direction.

FIG. 8 shows the correction along the course direction; it has been already found how the characteristic points for the two sizes are to be moved. With respect to the characteristic points for the two sizes, the knitting widths along the course direction are denoted by x1 and x2, and the knitting width for a size under treatment is denoted by x. Then, as shown in FIG. 8, the component $\alpha$ of the correction vector for the knitting width x is determined, and $\alpha \cdot x$ is the course directional component of the correction vector.

Figure 9:
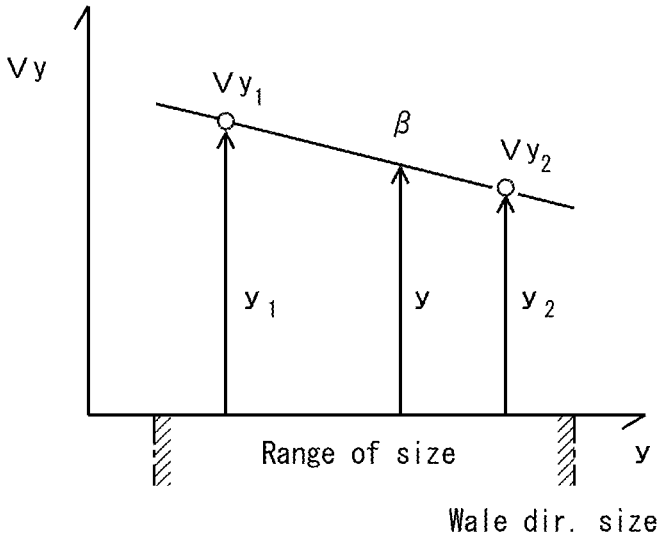
FIG. 9 is a diagram schematically illustrating correction along the wale direction.

FIG. 9 shows the correction along the wale direction. The shift amounts Vy1 and Vy2 for the two sizes are interpolated according to the wale length y for a size under treatment, and the component $\beta$ of the correction vector is determined. In both FIGS. 8 and 9, for sizes beyond the test-knitted two sizes, extrapolation is performed to determine the correction vectors. Furthermore, the correction vector is present at each characteristic point, and the positions of the characteristic points in the pattern data or the knitting data are corrected.

Figure 10:
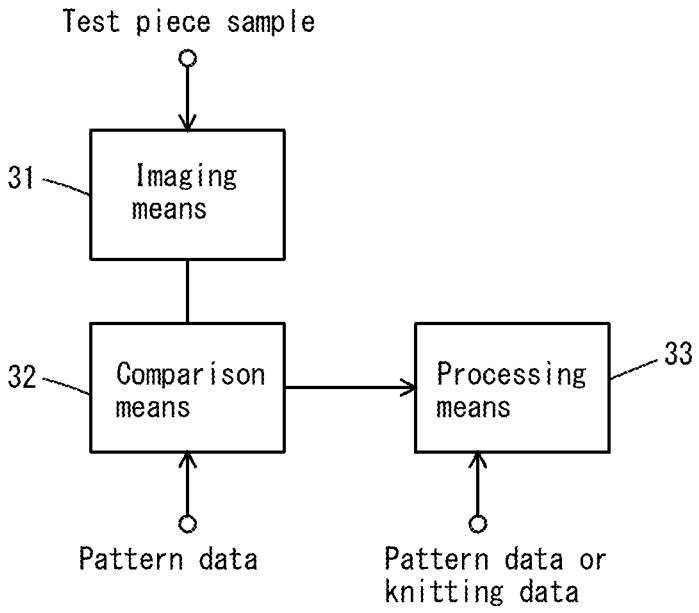
FIG. 10 is a diagram illustrating a modification where the system compares sizes of the test pieces with sizes indicated by initial pattern data.

FIG. 10 shows an editing means 30 according to a modification; an imaging means 31 captures the images of the test pieces (shoe uppers) and sizes of portions are measured. The obtained sizes are compared with the sizes specified by the pattern data by a comparison means 32 and the knitting data or the pattern data is edited by a processing means 33 so that errors in the sizes are eliminated.

FIGS. 11 to 18 show a second embodiment. A knitted fabric constituting a knitted product may comprise a main body and a separable portion. For example, when the separable portion is knitted and then the main body is knitted with usage of flechage, a knitted fabric having the main body and the flechaged portion is resultant. Here, during the knitting, the separable portion is knitted through flechage or the like in order to change the wale direction, to insert inlay yarn diagonally to the longitudinal direction of the shoe upper, to change the three-dimensional knitted fabric or the like.

Figure 11:
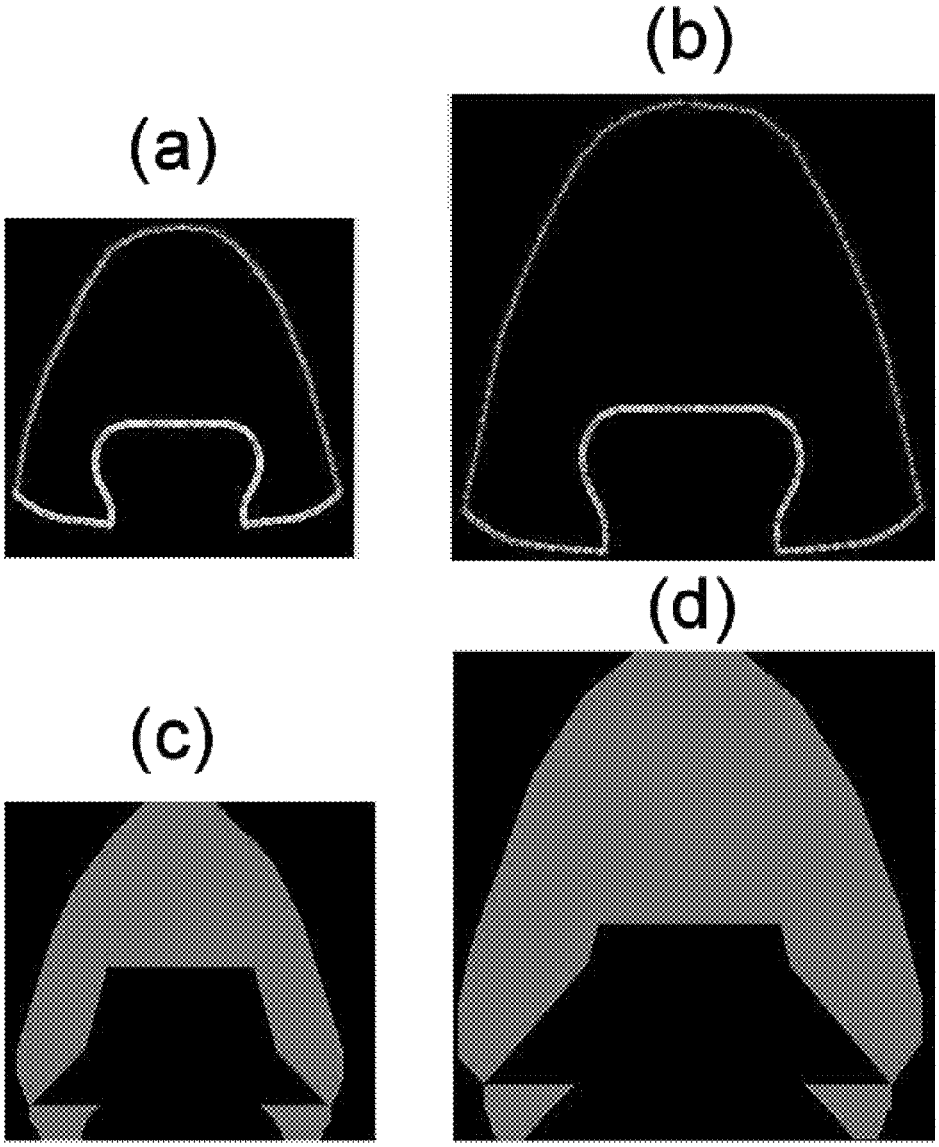
FIG. 11 is a diagram schematically illustrating pattern data and the resultant knitting data according to a second embodiment.

FIG. 11 show the initial pattern data of shoe uppers with flechaged portions, and the knitting data obtained through test knitting. FIG. 11(*a*) shows the initial pattern data for the smallest size and FIG. 11(*b*) shows the initial pattern data for the largest size; multiple characteristic points are arranged on the outlines.

FIG. 11(*c*) shows the knitting data for the smallest size after test knitting and FIG. 11(*d*) shows the knitting data for the largest size after test knitting. The knitting data are divided into the main body data and flechaged portion data (separable portions), and the boundaries between them constitute flechage lines.

The flechage in FIG. 11 is necessary, because the opening in the center in the lower portion serves as a top line and because an unshown rib structure portion is provided around the top line. Knitting is started from the rib structured portion and performed up to the upper toe, or reversely from the toe up to the top line, and thus the wale direction needs to be changed midway. In FIG. 11, knitting is started from the top line and performed up to the flechage line, and then the wale direction is changed at the flechage line so that it is directed toward the top from the bottom in the drawing. The positions of the flechage lines are determined through test knitting and are not determinable from the initial pattern data.

Figure 12:
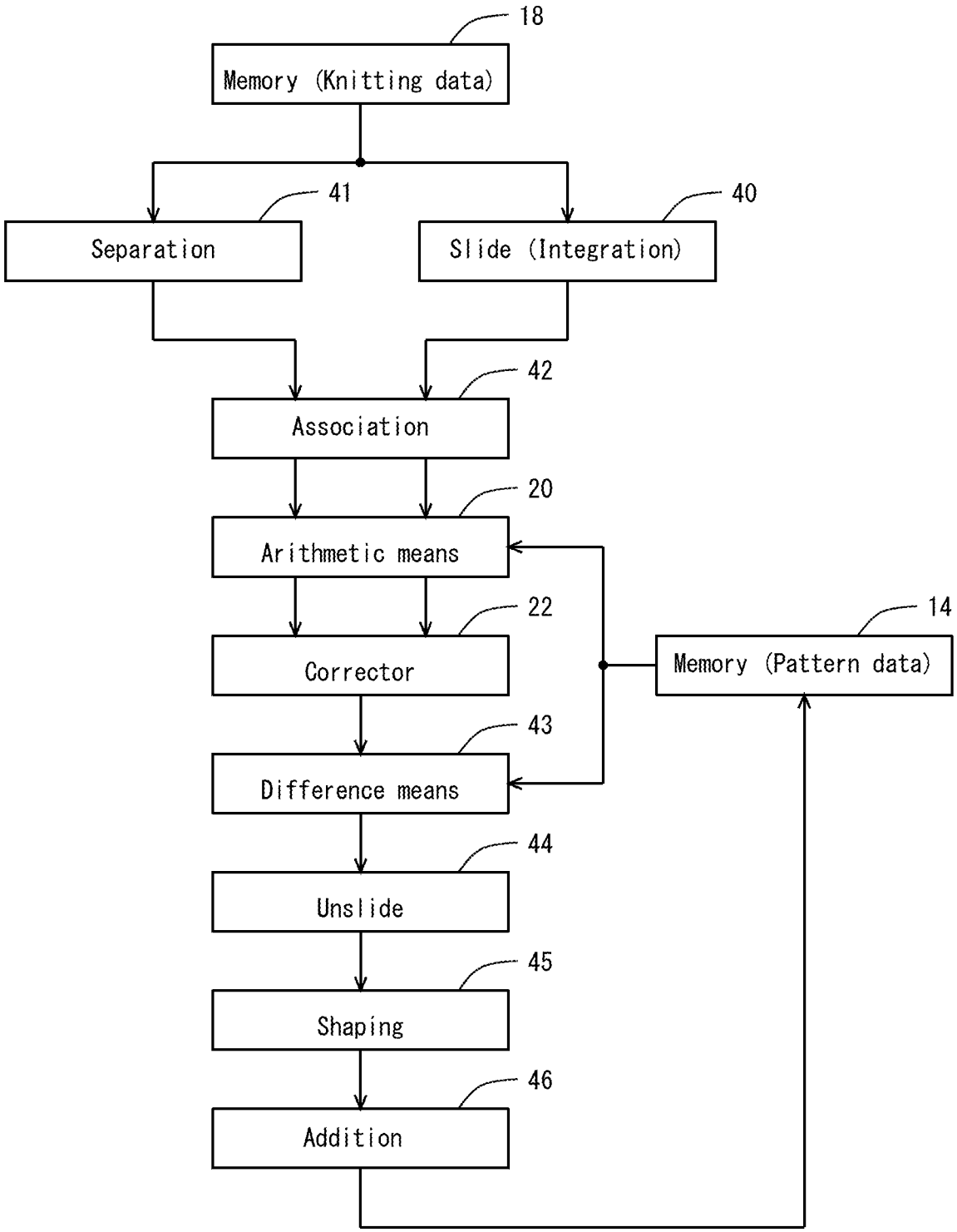
FIG. 12 is a block diagram illustrating the main part of a grading system according to the second embodiment.

FIG. 12 shows elements added to the grading system 2 in FIG. 2 for the second embodiment. A sliding means 40, a separation means 41, and an association means 42 are added between the memory 18 and the arithmetic means 20 in FIG. 2. Furthermore, a differential means 43, an un-sliding means 44, a shaping means 45, and an addition means 46 are added downstream of the corrector means 22 in FIG. 2. However, that the shaping means 45 may not be provided.

The second embodiment will be described from a situation when the knitting data shown in FIGS. 11(*c*) and 11(*d*) are stored in the memory 18. The sliding means 40 slides the flechaged portions upward to generate integrated data where the flechaged portions are integrated with the main body. The separation means 41 generates main body data where the flechaged portions are separated from the knitting data.

The association means 42 associates the characteristic points in the initial pattern data (FIGS. 11(*a*) and 11(*b*)) with the integrated data and the main body data. For example, some selected characteristic points are associated manually or automatically, and the remaining characteristic points are associated automatically.

Figure 15:
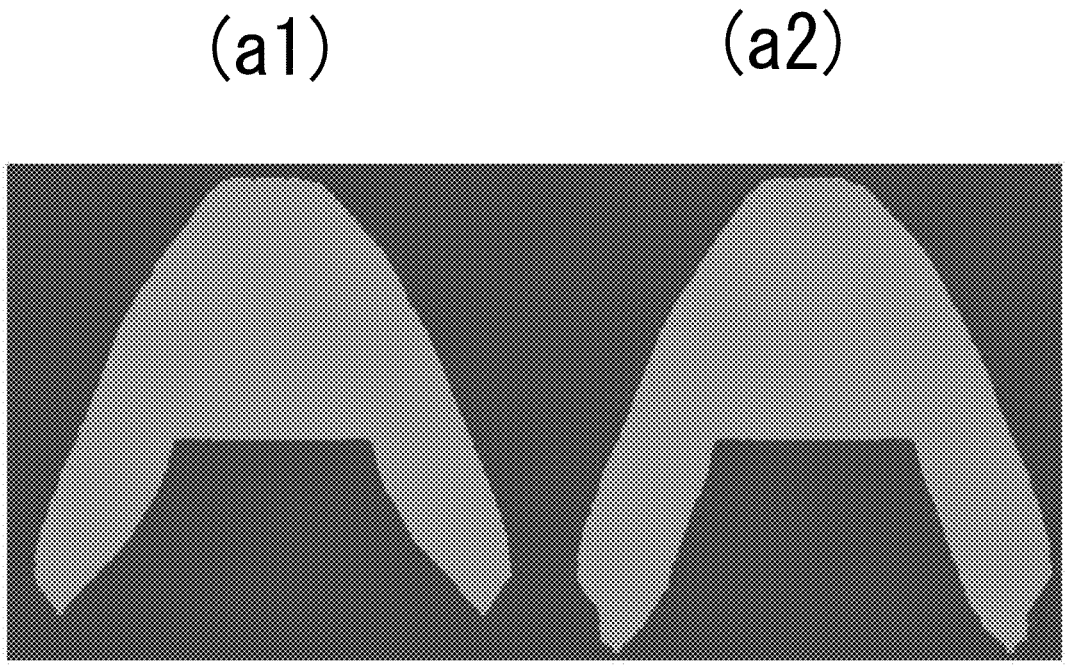
FIG. 15 illustrates knitting data for an intermediate size corrected based on the knitting data for the largest and smallest sizes after test knitting.

When the characteristic points are associated, the shift amount from the initial pattern data for each characteristic point is calculated by the arithmetic means 20. This process is performed, for example, for the two sizes of the largest and the smallest. For example, the two shift amounts for the two sizes of the largest and the smallest are calculated for each characteristic point. Then, the corrector means 22 generates two corrected pattern data for each intermediate size using the two correction amounts. The corrected pattern data to be generated are one corresponding to the integrated data and one corresponding to the main body data. The two corrected pattern data are converted to the two knitting data, namely, corrected integrated data and corrected main body data. FIG. 15(*a*1) shows the corrected main body data without the flechaged portions and FIG. 15(*a*2) shows the corrected integrated data with the flechaged portions being integrated.

Figure 16:
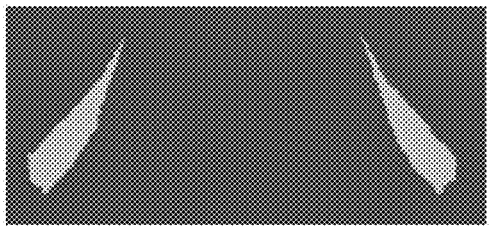
FIG. 16 illustrates generation of data of the flechaged portions for the intermediate size.
Figure 16:
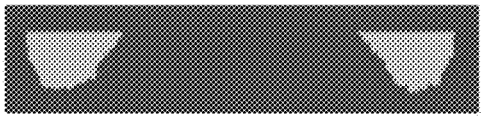

The differential means 43 calculates the differential areas between the corrected integrated data in FIG. 15(*a*2) (with the flechaged portions being integrated) and the corrected main body data in FIG. 15(*a*1) (with the flechaged portions being separated). The results are shown in FIG. 16(*a*). The un-sliding means 44 unslides the areas, as shown in FIG. 16(*b*). Since the outlines of the flechaged portions may have unnatural uneveness as shown in FIG. 16(*b*), the outlines of the flechaged portions are shaped by the shaping means 45 to reduce the unevenness, if necessary. After the un-sliding, the addition means 46 adds the areas, preferably the shaped areas, to the corrected main body data.

Figure 17:
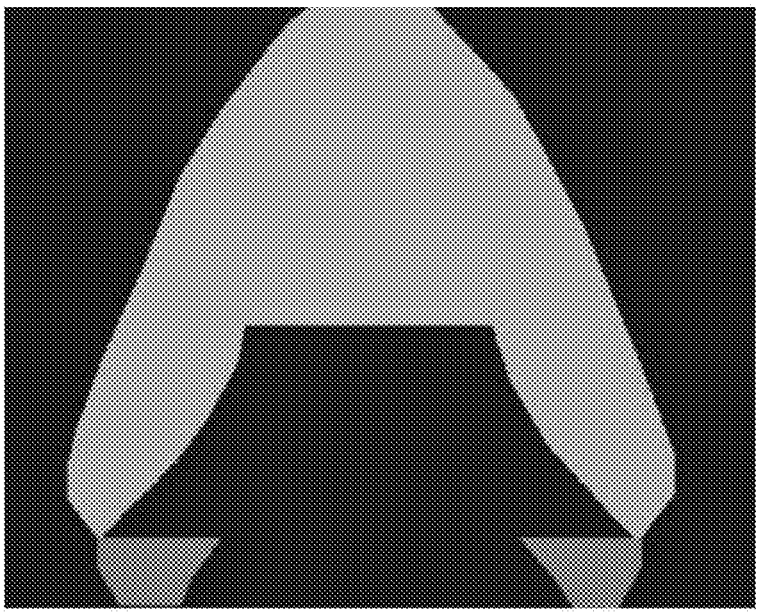
FIG. 17 illustrates the corrected knitting data resultant after shaping the data in FIG. 16(*b*) and the data in FIG. 15(*a*1).

The corrected main body data in FIG. 15(*a*1) indicates the shape of the main body and FIG. 16(*b*) indicates the areas of the flechaged portions. The corrected knitting data in FIG. 17 is obtained by the addition means 46 by adding the areas of the flechaged portions to the corrected main body data or to the corrected integrated data from which the areas are removed. The actual knitting data includes, in addition, the rib structured portion near the top line and the like; they are omitted.

Figure 13:
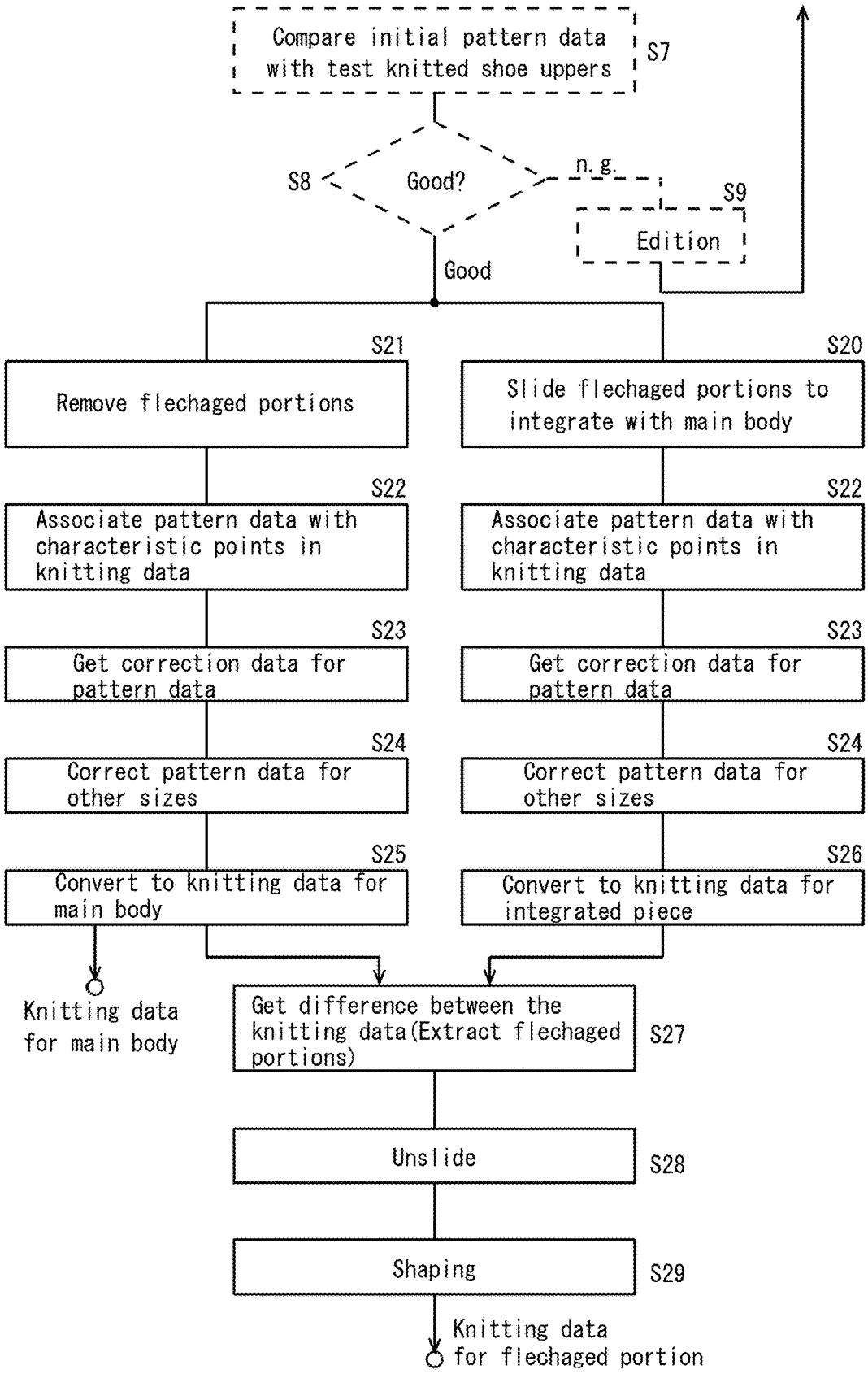
FIG. 13 is a flowchart illustrating a general algorithm according to the second embodiment.

FIG. 13 shows the algorithm of the second embodiment where steps 1 to 8 in FIG. 4 are carried out and then steps 20 to 29 in FIG. 13 are carried out instead of steps 10 to 12 in FIG. 4.

Figure 14:
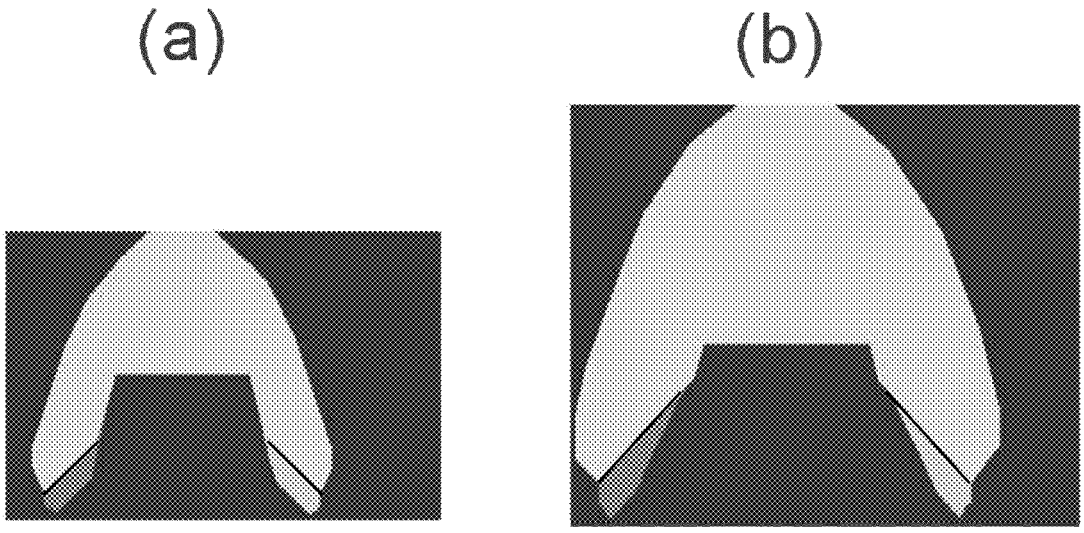
FIG. 14 illustrates knitting data where flechaged portions are slid and integrated into the main body.

In step 20, the flechaged portions are slid vertically upward in FIGS. 11(*c*) and 11(*d*) and are integrated with the main body, so that integrated data is formed. Here, characteristics in the shape of the flechaged portions before sliding may be stored and may be referenced for the un-sliding. For example, in FIGS. 11(*c*) and 11(*d*), the upper sides of the flechaged portions are flat. In some knitting data, the lower sides of the flechaged portions are flat, and in another knitting data, the upper and lower sides are inclined in reverse directions with each other. In step 21, the main body data is generated so that the main body remains and the flechaged portions are separated. Examples of the resultant data are shown in FIGS. 14(*a*) and 14(*b*). Note that the integrated data and the main body data are both knitting data. Furthermore, the knitting data have the property as an image data where one stitch is indicated by one dot.

In step 22, the characteristic points in the initial pattern data are associated with the integrated data and the main body data. Note that it is also possible to once convert the integrated data and the main body data into pattern data, and then to associate the characteristic points in the initial pattern data with the converted pattern data. Furthermore, since it is unclear which portion of the initial pattern data corresponds to the main body, it is not the case that the portion corresponding to the main body is extracted from the initial pattern data and is associated with the main body data.

In step 23, the correction amounts at each characteristic point for the initial pattern data are determined for both the main body data and the integrated data. The data are present for the largest size and the smallest size, and thus four types of correction amounts are obtained in total. Then, in step 24, the correction amounts for intermediate sizes are determined by interpolating or extrapolating the correction amounts for the largest size and the smallest size obtained from the integrated data. Similarly, the correction amounts for the intermediate sizes are determined by interpolating or extrapolating the correction amounts for the largest size and the smallest size obtained from main body data. Accordingly, for each intermediate size, the two data of the corrected pattern data are resultant, one corrected based on the main body data, and the other corrected based on the integrated data. Since the pattern data is the data indicating the outline of a knitted fabric, the corrected pattern data may be converted into knitting data where the inside of the data is filled with stitches. Accordingly, from the corrected pattern data, the two knitting data, namely, the corrected integrated data and the corrected main body data, are determined (steps 25 and 26). An example of the corrected main body data is shown in FIG. 15(*a*1), and an example of the corrected integrated data is shown in FIG. 15(*a*2).

In step 27, the difference between the corrected integrated data in FIG. 15(*a*2) and the corrected main body data in FIG. 15(*a*1) is determined. Accordingly, the areas in FIG. 16(*a*) are determined; they indicate the shapes of flechaged portions but have unnatural shapes because they were slid in step 20. Therefore, in step 28, un-sliding is performed, and they are converted to the data in FIG. 16(*b*).

The un-sliding will be described. In FIG. 16(*a*), the flechaged portions are approximately a quadrilateral, and their upper sides are longer than their lower sides. Accordingly, the upper sides are assumed to be flat before the sliding, and un-sliding is performed as in FIG. 16(*b*). If the lower sides are longer than the upper sides, un-sliding will be performed so that the lower sides are made flat. The shapes of the flechaged portions depend on whether the upper sides are made flat or the lower sides are made flat.

Knitting data may be represented as if they are image data; one dot corresponds to one stitch. Regarding the un-sliding, the flechaged portions are regarded as strips of stitches where the stitches are arranged along the vertical direction and the strips are arranged laterally. The strips are slid in the height direction, and in the case of FIG. 16, the upper sides of the strips are aligned flat, and the heights of the upper sides are made uniform.

When the flechaged portions are slid in step 20, the characteristics of the shapes of the flechaged portions may be stored, and the un-sliding may be performed so that the portions are made similar to the stored shapes.

When un-sliding is performed as in FIG. 16(*b*), the shapes of the flechaged portions may include unnatural unevenness, and step 29 may be executed to shape the outline.

When executing steps 20 to 28 or 20 to 29, the areas representing the corrected flechaged portions are obtained for each size. Accordingly, the corrected knitting data in FIG. 17 is determined.

Figure 18:
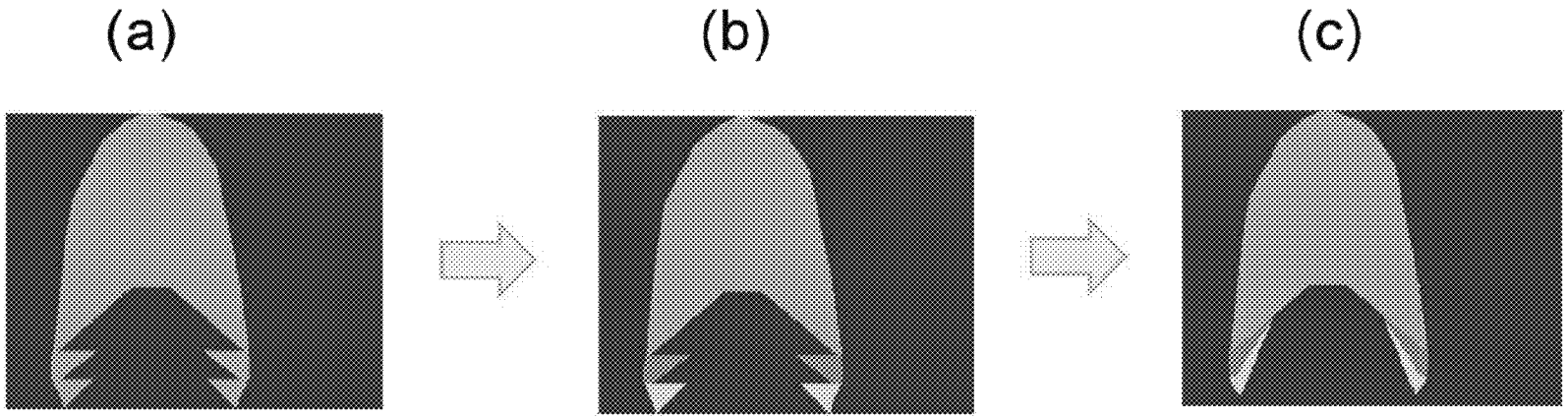
FIG. 18 is a diagram illustrating the merging of the flechaged portions to the main boy for the knitting data with two flechaged portions at each of the left and right sides shown in (a) with specifying the area of the flechaged portions in different colors shown in (b) and sliding the flechaged portions upwardly in (c).

The pattern data in FIG. 11 are mere examples. FIG. 18 shows data having two flechaged portions on each of the left and right sides. When the data in FIG. 18(*a*) is obtained through the test knitting, then the flechaged portions are specified, for example, manually (FIG. 18(*b*)) in order to clarify the regions to be slid. Then, the data are integrated as shown in FIG. 18(*c*).

The flechaged portions may be provided at various portions in order to knit three-dimensional knitted products. Flechage is useful, for example, to insert inlay yarns obliquely to the longitudinal direction of a shoe upper, or to knit the shoe upper or the like into a three-dimensional shape. In these cases, main bodies are often located both over the flechaged portions and under the flechaged portions, and when the flechaged portions are separated, the main bodies over and under the flechaged portions are integrated with each other.

DESCRIPTION OF REFERENCE NUMERALS

2 Grading system
4 CAD device
6 2D converter
8 Printer
10 Knitting machine
12 User interface
13 System input
14 Memory
16 Data converter
17 System output
18 Memory
20 Arithmetic means
22 corrector means
30 Editing means
31 Imaging means
32 Comparison means
33 Processing means
40 Sliding means
41 Separation means
42 Association means
43 Differentiation means
44 Un-sliding means
45 Shaping means
46 Addition means

The invention claimed is:

1. A grading method for a knitted product for obtaining knitting data of the knitted product for at least three separate sizes by means of a grading system, the method comprising:

a: a step for inputting pattern data of the knitted product as initial pattern data to the grading system;

b: a step for inputting gauge data indicating a course directional size and a wale directional size of stitches to the grading system;

c: a step for converting the initial pattern data into initial knitting data based on the gauge data by means of the grading system and for test knitting the knitted product on a knitting machine based on the initial knitting data;

d: a step for comparing a size of the test-knitted product with a size indicated by the initial pattern data manually or by means of the grading system;

e: a step for correcting the knitting data manually or by means of the grading system and for test knitting the knitted product on a knitting machine based on the corrected knitting data, when an error between the size of the test-knitted product and the size indicated by the initial pattern data exceeds a predetermined range; and f: a step for repeating the steps d and e until the error between the size of the test-knitted product and the size indicated by the initial pattern data is within the predetermined range, characterized in that:

g: the steps c to f are executed on at least two separate sizes of the knitted product, and the method further comprises:

h: a step for determining correction amounts to the initial pattern data or to the initial knitting data, in order to make the initial pattern data or the initial knitting data nearer to the knitting data or to the pattern data of the test-knitted product test-knitted in the step f, by means of the grading system, when, in the step f, the error between the size of the test-knitted product test-knitted in the step f and the size indicated by the initial pattern data is within the predetermined range; and i: a step for correcting pattern data or knitting data for sizes of un-test-knitted product through interpolation or extrapolation of the correction amounts for the at least two sizes determined in the step h, by means of the grading system.

2. The grading method for a knitted product according to claim 1, further comprising:

j: a step for specifying a plurality of characteristic points along an outline on the pattern data and along an outline of a knitted fabric in the knitting data by means of the grading system, wherein the plurality of characteristic points are associated with each other between the pattern data and the knitting data and are further associated with each other between pattern data for separate sizes and k: wherein, in the step h, the grading system determines correction amounts for respective characteristic points based on shift amounts of the characteristic points between the knitting data or the pattern data of the knitted product test-knitted in the step f and the initial pattern data or the initial knitting data.

3. The grading method for a knitted product according to claim 2, characterized in that the knitted product comprises a plurality of areas having different characteristics and that, in the step j, the grading system specifies characteristic points at a border between the areas.

4. The grading method for a knitted product according to claim 3, characterized in that the correction amounts comprise a correction component along the course direction and a correction component along the wale direction, that the correction component along the course direction is a ratio of shift amounts of the characteristic points along the course direction and a knitting width along the course direction of the knitted product, and that, in the step i, the pattern data or the knitting data is corrected by multiplying the correction component along the course direction determined through the interpolation or extrapolation and the knitting width along the course direction of the knitted product for each size.

5. The grading method for a knitted product according to claim 1, characterized in that the knitted product is a footwear.

6. The grading method for a knitted product according to claim 1, characterized in that the knitting data of the knitted product for each size is provided with a main body and a separable portion, and that the step h further comprises:

h-1: a step for generating two data of integrated data where the separable portion is slid and merged with the main body and main body data where the separable portion is separated and the main body remains, based on the knitting data of the test-knitted product for the at least two sizes; and h-2: a step for generating, for each size of the test-knitted product, two correction amounts of correction amounts for converting the initial pattern data to the integrated data and correction amounts for converting the initial pattern data to the main body data, and that the step i further comprises:

i-1: a step for generating, for each size of un-test-knitted product, two corrected pattern data with correcting the initial pattern data through interpolation or extrapolation of the two correction amounts for the sizes test knitted and for generating two knitting data of corrected integrated data and corrected main body data based on the two corrected pattern data;

i-2: a step for determining an area included in the corrected integrated data and not included in the corrected main body data through differentiation for each size of un-test knitted product, for sliding the determined area in a reverse direction to a direction in the integration, and for generating an area representing the separable portion; and i-3: a step for adding the area representing the separable portion to the corrected main body data and for generating the corrected knitting data for each size of un-test-knitted product.

7. The grading method for a knitted product according to claim 6, characterized in that, in the step i-2, the determined area is approximated as a polygon having an upper side and a lower side and the determined area is slid in such a way that the longer one of the upper side and the lower side is made flat.

8. The grading method for a knitted product according to claim 6, characterized in that, in the step h-1, characteristics in the shape of the separable portion prior to the integration are stored and that, in the step i-2, the determined area is slid so as to approximate the shape of the separable portion prior to the integration.

9. A grading system for a knitted product comprising:

a memory configured to store input of initial pattern data;

a memory configured to store input values of gauge data indicating a course directional size and a wale directional size of stitches; and a data converter configured to convert pattern data into knitting data based on the gauge data, characterized by:

an editing means for editing the pattern data or the knitting data according to manual input or automatically so that a size of the knitted product knitted in accordance with the knitting data is made nearer to a size indicated by the initial pattern data; and a corrector means configured to store correction amounts for the pattern data or the knitting data edited by the editing means for at least two sizes, and to correct pattern data or knitting data for other sizes through interpolation or extrapolation based on the stored correction amounts.

10. The grading system for a knitted product according to claim 9, characterized by, in order to process a knitted product whose knitting data contains a main body and a separable portion, the grading system for a knitted product further comprising:

a sliding means for sliding the separable portion to the main body with respect to the knitting data edited by the editing means in order to obtain integrated data;

a separation means for separating the separable portion from the main body and for obtaining main body data with respect to the knitting data edited by the editing means, wherein the corrector means generates two correction amounts of one from the initial pattern data to the integrated data and the other from the initial pattern data to the main body data, corrects for other sizes the initial pattern data through interpolation or extrapolation of the two correction amounts, generates two corrected pattern data, and generate two knitting data of corrected integrated data and corrected main body data based on each of the corrected pattern data, a differential means for determining an area included in the corrected integrated data and not included in the corrected main body data through differentiation;

an un-sliding means for sliding, in a reverse direction to a direction in the integration, the area determined by the differential means and for generating an area representing the separable portion; and an addition means for adding the area representing the separable portion to the corrected main body data and for generating corrected knitting data.

11. The grading method for a knitted product according to claim 2, characterized in that the knitted product is a footwear.

12. The grading method for a knitted product according to claim 3, characterized in that the knitted product is a footwear.

13. The grading method for a knitted product according to claim 4, characterized in that the knitted product is a footwear.

14. The grading method for a knitted product according to claim 2, characterized in that the knitting data of the knitted product for each size is provided with a main body and a separable portion, and that the step h further comprises:

h-1: a step for generating two data of integrated data where the separable portion is slid and merged with the main body and main body data where the separable portion is separated and the main body remains, based on the knitting data of the test-knitted product for the at least two sizes; and h-2: a step for generating, for each size of the test-knitted product, two correction amounts of correction amounts for converting the initial pattern data to the integrated data and correction amounts for converting the initial pattern data to the main body data, and that the step i further comprises:

i-1: a step for generating, for each size of un-test-knitted product, two corrected pattern data with correcting the initial pattern data through interpolation or extrapolation of the two correction amounts for the sizes test knitted and for generating two knitting data of corrected integrated data and corrected main body data based on the two corrected pattern data;

i-2: a step for determining an area included in the corrected integrated data and not included in the corrected main body data through differentiation for each size of un-test knitted product, for sliding the determined area in a reverse direction to a direction in the integration, and for generating an area representing the separable portion; and i-3: a step for adding the area representing the separable portion to the corrected main body data and for generating the corrected knitting data for each size of un-test-knitted product.

15. The grading method for a knitted product according to claim 3, characterized in that the knitting data of the knitted product for each size is provided with a main body and a separable portion, and that the step h further comprises:

h-1: a step for generating two data of integrated data where the separable portion is slid and merged with the main body and main body data where the separable portion is separated and the main body remains, based on the knitting data of the test-knitted product for the at least two sizes; and h-2: a step for generating, for each size of the test-knitted product, two correction amounts of correction amounts for converting the initial pattern data to the integrated data and correction amounts for converting the initial pattern data to the main body data, and that the step i further comprises:

i-1: a step for generating, for each size of un-test-knitted product, two corrected pattern data with correcting the initial pattern data through interpolation or extrapolation of the two correction amounts for the sizes test knitted and for generating two knitting data of corrected integrated data and corrected main body data based on the two corrected pattern data;

i-2: a step for determining an area included in the corrected integrated data and not included in the corrected main body data through differentiation for each size of un-test knitted product, for sliding the determined area in a reverse direction to a direction in the integration, and for generating an area representing the separable portion; and i-3: a step for adding the area representing the separable portion to the corrected main body data and for generating the corrected knitting data for each size of un-test-knitted product.

16. The grading method for a knitted product according to claim 4, characterized in that the knitting data of the knitted product for each size is provided with a main body and a separable portion, and that the step h further comprises:

h-1: a step for generating two data of integrated data where the separable portion is slid and merged with the main body and main body data where the separable portion is separated and the main body remains, based on the knitting data of the test-knitted product for the at least two sizes; and h-2: a step for generating, for each size of the test-knitted product, two correction amounts of correction amounts for converting the initial pattern data to the integrated data and correction amounts for converting the initial pattern data to the main body data, and that the step i further comprises:

i-1: a step for generating, for each size of un-test-knitted product, two corrected pattern data with correcting the initial pattern data through interpolation or extrapolation of the two correction amounts for the sizes test knitted and for generating two knitting data of corrected integrated data and corrected main body data based on the two corrected pattern data;

i-2: a step for determining an area included in the corrected integrated data and not included in the corrected main body data through differentiation for each size of un-test knitted product, for sliding the determined area in a reverse direction to a direction in the integration, and for generating an area representing the separable portion; and i-3: a step for adding the area representing the separable portion to the corrected main body data and for generating the corrected knitting data for each size of un-test-knitted product.

17. The grading method for a knitted product according to claim 5, characterized in that the knitting data of the knitted product for each size is provided with a main body and a separable portion, and that the step h further comprises:

h-1: a step for generating two data of integrated data where the separable portion is slid and merged with the main body and main body data where the separable portion is separated and the main body remains, based on the knitting data of the test-knitted product for the at least two sizes; and h-2: a step for generating, for each size of the test-knitted product, two correction amounts of correction amounts for converting the initial pattern data to the integrated data and correction amounts for converting the initial pattern data to the main body data, and that the step i further comprises:

i-1: a step for generating, for each size of un-test-knitted product, two corrected pattern data with correcting the initial pattern data through interpolation or extrapolation of the two correction amounts for the sizes test knitted and for generating two knitting data of corrected integrated data and corrected main body data based on the two corrected pattern data;

i-2: a step for determining an area included in the corrected integrated data and not included in the corrected main body data through differentiation for each size of un-test knitted product, for sliding the determined area in a reverse direction to a direction in the integration, and for generating an area representing the separable portion; and i-3: a step for adding the area representing the separable portion to the corrected main body data and for generating the corrected knitting data for each size of un-test-knitted product.

* * * * *